US011462143B2

(12) United States Patent
Wu et al.

(10) Patent No.: US 11,462,143 B2
(45) Date of Patent: Oct. 4, 2022

(54) AREA BRIGHTNESS ADJUSTING METHOD AND DISPLAY THEREFOR

(71) Applicant: Lenovo (Beijing) Limited, Beijing (CN)

(72) Inventors: Hailong Wu, Beijing (CN); Lipeng Wu, Beijing (CN)

(73) Assignee: LENOVO (BEIJING) LIMITED, Beijing (CN)

( * ) Notice: Subject to any disclaimer, the term of this patent is extended or adjusted under 35 U.S.C. 154(b) by 0 days.

(21) Appl. No.: 17/473,752

(22) Filed: Sep. 13, 2021

(65) Prior Publication Data

US 2022/0208053 A1 Jun. 30, 2022

(30) Foreign Application Priority Data

Dec. 31, 2020 (CN) ..... 202011624461.8

(51) Int. Cl.
*G09G 3/20* (2006.01)

(52) U.S. Cl.
CPC ..... *G09G 3/20* (2013.01); *G09G 2320/0233* (2013.01); *G09G 2320/046* (2013.01); *G09G 2320/0686* (2013.01); *G09G 2354/00* (2013.01); *G09G 2360/145* (2013.01)

(58) Field of Classification Search
CPC ..... G09G 3/20; G09G 2320/0233; G09G 2320/046; G09G 2320/0686; G09G 2354/00; G09G 2360/145; G06F 3/0484–0486
See application file for complete search history.

(56) References Cited

U.S. PATENT DOCUMENTS

| | | | | |
|---|---|---|---|---|
| 11,067,853 | B1 * | 7/2021 | Mei | G09G 3/3406 |
| 2018/0039400 | A1 * | 2/2018 | Pettey | G06F 3/0485 |
| 2019/0243527 | A1 * | 8/2019 | Kuribayashi | G06F 3/0488 |

FOREIGN PATENT DOCUMENTS

| | | | |
|---|---|---|---|
| CN | 105955692 | A | 9/2016 |
| CN | 106155692 | A | 11/2016 |
| CN | 110164398 | A | 8/2019 |
| CN | 111724732 | A | 9/2020 |

* cited by examiner

*Primary Examiner* — Gene W Lee
(74) *Attorney, Agent, or Firm* — Anova Law Group, PLLC

(57) ABSTRACT

An information processing method includes obtaining an area brightness adjustment instruction, and adjusting brightness of a first area of a display screen based on the area brightness adjustment instruction, so that the brightness of the first area is same as brightness of a second area of the display screen. The first area corresponds to a collection area of an image collection assembly. The image collection assembly senses light passing through the first area of the display screen to form an image. The first area is a partial area of the display screen. The second area is an area of the display screen excluding the first area.

13 Claims, 10 Drawing Sheets

AREA BRIGHTNESS ADJUSTING METHOD AND DISPLAY THEREFOR

CROSS-REFERENCE TO RELATED APPLICATION

This application claim priority to Chinese Patent Application No. 202011624461.8, filed Dec. 31, 2020, the entire content of which is incorporated herein by reference.

TECHNICAL FIELD

The present disclosure relates to the technical field of electronic apparatus and, more particularly, to an information processing method and device.

BACKGROUND

With the development of electronic technology, full screens with ultra-high screen-to-body ratio have appeared.

In a full screen, a camera under display (CUD) area is set in a display screen by setting a camera under the display screen. This area needs to have a high light transmittance so that the set camera can perform acquisition, and this area also needs to be able to display content.

In existing technologies, in order to meet requirements for this area in the display screen, a structure different from other areas is adopted. After the display screen is used for a while, brightness of the CUD area will be different from brightness of other areas, so that screen display effect is poor.

SUMMARY

In accordance with the disclosure, there is provided an information processing method including obtaining an area brightness adjustment instruction, and adjusting brightness of a first area of a display screen based on the area brightness adjustment instruction, so that the brightness of the first area is same as brightness of a second area of the display screen. The first area corresponds to a collection area of an image collection assembly. The image collection assembly senses light passing through the first area of the display screen to form an image. The first area is a partial area of the display screen. The second area is an area of the display screen excluding the first area.

Also in accordance with the disclosure, there is provided an electronic apparatus including a main body, a display screen arranged at a side of the main body and including a first area and a second area that is an area of the display screen excluding the first area, an image collection assembly arranged at a side of the display screen close to the main body and including a collection area corresponding to the first area of the display screen and sensing light passing through the first area of the display screen to form an image, and a processor that obtains an area brightness adjustment instruction, and adjusts brightness of the first area of the display screen based on the area brightness adjustment instruction, so that the brightness of the first area is same as brightness of the second area.

BRIEF DESCRIPTION OF THE DRAWINGS

In order to explain the embodiments of the present disclosure more clearly, reference is made to the accompanying drawings, which are used in the description of the embodiments. Obviously, the drawings in the following description are some embodiments of the present disclosure, and other drawings can be obtained from these drawings without any inventive effort for those of ordinary skill in the art.

DETAILED DESCRIPTION OF THE EMBODIMENTS

The technical solutions in the embodiments of the present disclosure will be described in detail with reference to the accompanying drawings. Obviously, the described embodiments are only some of rather than all the embodiments of the present disclosure. Based on the described embodiments, all other embodiments obtained by those of ordinary skill in the art without inventive effort shall fall within the scope of the present disclosure.

Figure 1:
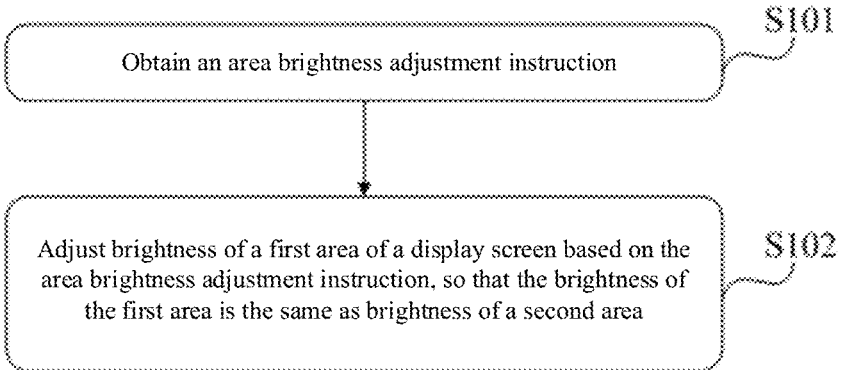
FIG. 1 is a flow chart of an example information processing method consistent with the present disclosure.

FIG. 1 is a flow chart of an example information processing method consistent with the present disclosure. The method is applied to an electronic apparatus, and includes the following processes.

S101, obtaining an area brightness adjustment instruction.

The area brightness adjustment instruction is configured to adjust brightness of a first area of a display screen of the electronic apparatus.

In specific implementation, automatic brightness adjustment can be performed based on set conditions, or a user can manually perform brightness adjustment. Different manners of triggering the area brightness adjustment instruction will be described in detail in subsequent embodiments.

S102, adjusting the brightness of the first area of the display screen based on the area brightness adjustment instruction, so that the brightness of the first area is the same as brightness of a second area.

The first area corresponds to a collection area of an image collection assembly. The image collection assembly senses light passing through the first area of the display screen to form an image. The first area is a partial area of the display screen, and the second area of the display screen is an area of the display screen excluding the first area.

In some embodiments, the first area is a multiplexed area, and its light transmittance is much higher than other areas.

The first area corresponds to the collection area of the image collection assembly. The image collection assembly senses the light passing through the first area of the display screen to form the image, that is, the image collection assembly can perform image acquisition on outside of the electronic apparatus through the first area. The first area can also be used as a partial area of the display screen for image display.

After the area brightness adjustment instruction is obtained, the brightness of the first area of the display screen is adjusted so that the brightness of the first area is the same as brightness of other areas in the display screen. When a content is displayed on the display screen, an overall brightness of the display screen is the same to prevent problem of "screen burn" (i.e., brightness of different areas is different).

Figure 2:
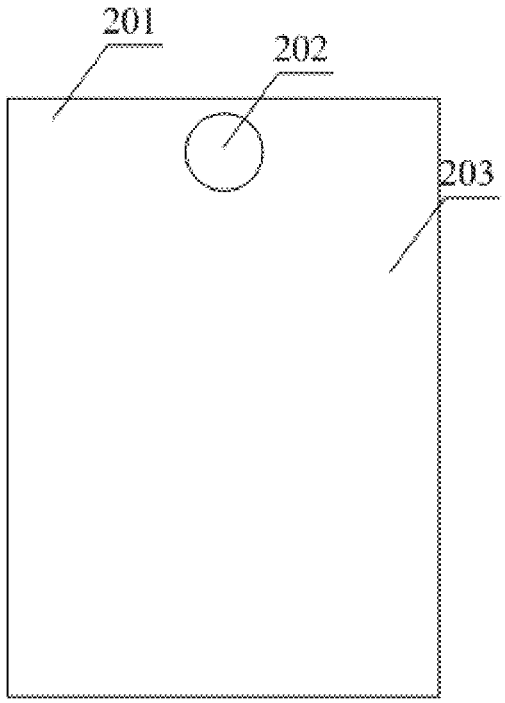
FIG. 2 is a schematic structural diagram of a display screen involved in an information processing method consistent with the present disclosure.

FIG. 2 is a schematic structural diagram of the display screen involved consistent with the present disclosure. A display screen 201 of the electronic apparatus includes a first area 202 and a second area 203, and the screen is, in some embodiments, a liquid crystal screen. The first area is, in some embodiments, a camera under display (CUD) area with an organic light-emitting diode (OLED) structure. In some embodiments, an indium tin oxide (ITO) film (i.e., an indium tin oxide semiconductor transparent conductive film) structure is used in the CUD area, and a non-ITO structure, such as a thin film transistor (TFT), is used in other areas.

Working principle of an electronic screen is that a voltage applied at two ends of a RGB organic light emission layer (in the CUD area) and a liquid crystal layer (in other areas) causes arrangement of molecules therein to change to achieve light shielding and light transmission, so as to display images of different shades. Because the ITO used in the CUD area has a different structure from other areas, an aging progress is also different. Also, the ITO used in the CUD area has a higher impedance. In order to ensure brightness of this area, a current of this area needs to be increased, which will cause an amount of transferable electrons in the ITO of the CUD area to decrease after being used for a while, so that brightness of the CUD area is lower than that of other areas. In order to ensure that the brightness of the CUD area is consistent with that of other areas, an area brightness adjustment is performed.

In summary, the information processing method consistent with the present disclosure includes: obtaining the area brightness adjustment instruction; adjusting the brightness of the first area of the display screen based on the area brightness adjustment instruction, so that the brightness of the first area is the same as the brightness of the second area. The first area corresponds to the collection area of the image collection assembly. The image collection assembly senses the light passing through the first area of the display screen to form the image. The first area is a partial area of the display screen, and the second area of the display screen is an area of the display screen excluding the first area. In this scheme, the brightness of the first area corresponding to the image collection assembly in the display screen is adjusted based on the brightness adjustment instruction, so that the brightness of the first area is consistent with the brightness of other areas in the display screen, which improves display effect of the screen.

Figure 3:
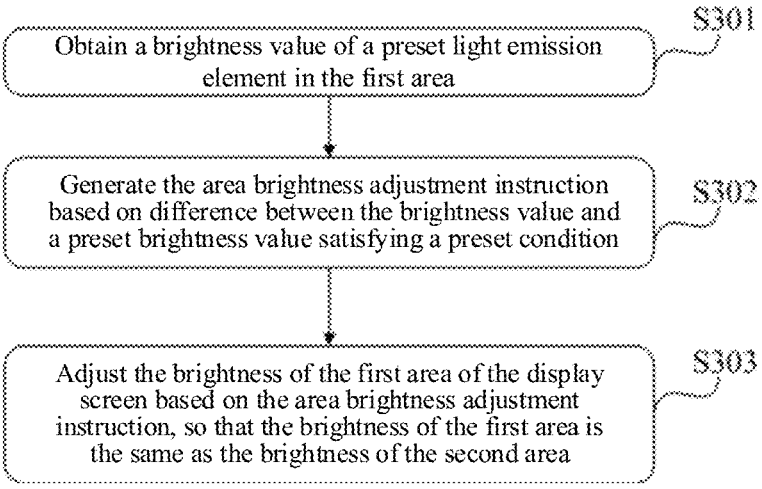
FIG. 3 is a flow chart of another example information processing method consistent with the present disclosure.

FIG. 3 is a flow chart of another example information processing method consistent with the present disclosure. The method includes the following processes.

S301, obtaining a brightness value of a preset light emission element in the first area.

A light emission element is preset in the ITO structure corresponding to the first area.

The brightness value of the light emission element is obtained under a condition that the light emission element normally emits light, so as to determine light emission brightness of the light emission element with a current power supply current.

The brightness of the first area can be adjusted in any case as long as operation of the electronic apparatus is not affected.

In specific implementation, in order to prevent the user from having problem of inconsistency between the brightness of the first area and the second area during use, the process is generally performed when the electronic apparatus is started to ensure user experience.

Figure 4:
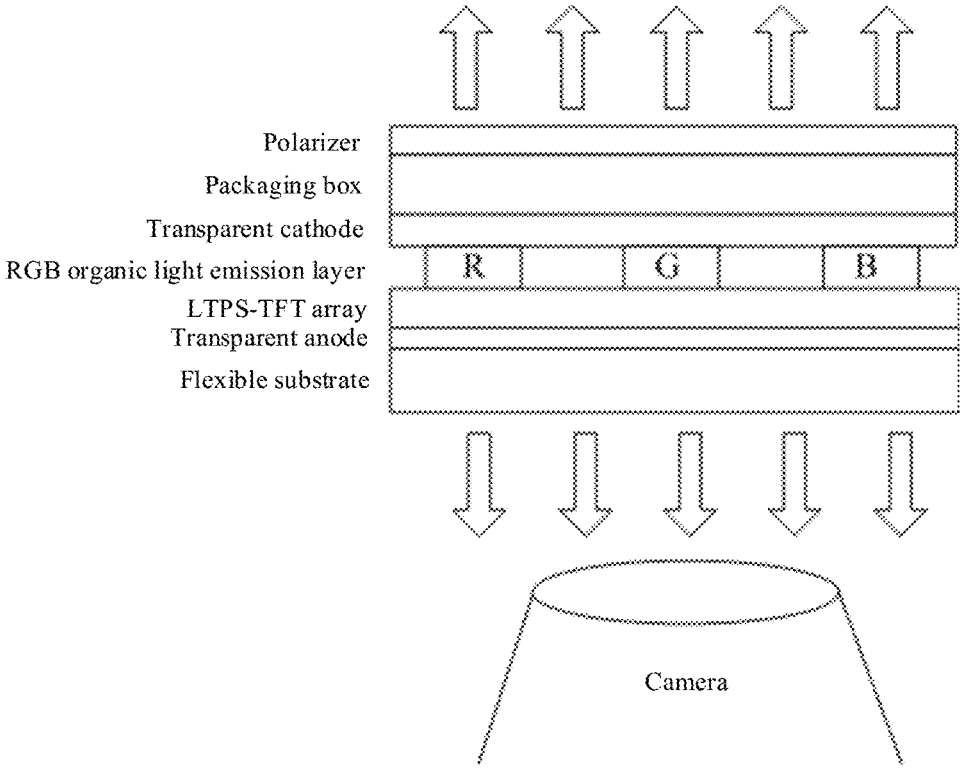
FIG. 4. is a schematic structural diagram of a first area in an information processing method consistent with the present disclosure.

FIG. 4 is a schematic structural diagram of the first area in the present disclosure, including: a polarizer, a packaging box, a transparent cathode, a red-green-blue (RGB) organic light emission layer, a transparent anode, a low-temperature polysilicon array (LTPS-TFT array), and a flexible substrate. The above-mentioned structures are arranged in sequence from outside to inside, and a camera is located at a side of the flexible substrate. In the figure, an arrow indicates a light transmission direction emitted by the RGB organic light emission layer. The light emitted by the RGB organic light emission layer can be emitted outward through the transparent cathode, the packaging box, and the polarizer, so that the user can visually perceive from outside of the display screen of the electronic apparatus. The light emitted by the RGB organic light emission layer can also be emitted inward through the transparent anode, the low-temperature polysilicon array (LTPS-TFT array), and the flexible substrate, so that the camera can sense the light to form the image.

The RGB organic light emission layer is controlled to emit white light, and the camera senses to generate the image, that is, the brightness value of the light emitted by the RGB organic light emission layer through the transparent anode is recorded by taking a picture.

S302, generating the area brightness adjustment instruction based on difference between the brightness value and a preset brightness value satisfying a preset condition.

The area brightness adjustment instruction is configured to instruct to adjust a current of the preset light emission element in the first area to a target adjustment current value.

The preset brightness value may be an initial brightness value of the first area of the electronic apparatus, and may be the brightness value of the light emitted by the RGB organic light emission layer through the transparent anode recorded by the camera before the electronic apparatus leaves a factory.

In some embodiments, the difference between the obtained brightness value of the first region and the preset brightness value is calculated, and the difference satisfies the preset condition, where the preset condition refers to a brightness difference that can be observed by the user with naked eyes.

For example, if the obtained brightness value is lower than 2% of the preset brightness value, then the preset condition is satisfied, and the area adjustment instruction is generated, where the difference is the brightness difference that can be observed by the user with naked eyes.

S303, adjusting the brightness of the first area of the display screen based on the area brightness adjustment instruction, so that the brightness of the first area is the same as the brightness of the second area.

In some embodiments, based on the difference between the preset brightness value and the obtained brightness value of the first area, a current value provided for the first area is linearly increased at a preset ratio. Also, during increase of the current value of the first area, the camera obtains the brightness value of the preset light emission element in the first area during the adjustment process according to a preset period, and compares with the preset brightness value. If the difference between the two is less than a preset value, the adjustment is ended, and a present current value is used as the target adjustment current value. If the difference between the two is not less than the preset value, the camera continues to obtain the brightness value of the preset light emission element in the first area during the adjustment process according to the preset period, until the difference between the two is less than the preset value.

Since a current value of the second area in the display screen is smaller than the current value of the first area, an aging progress of the second area is much smaller than that of the first area. Therefore, the brightness of the first area can be adjusted to the preset brightness value, and after the brightness is adjusted, the brightness of the first area and the second area are the same or very similar.

In summary, in the information processing method consistent with the present disclosure, obtaining the area brightness adjustment instruction includes: obtaining the brightness value of the preset light emission element in the first area; generating the area brightness adjustment instruction based on the difference between the brightness value and the preset brightness value satisfying the preset condition, and the area brightness adjustment instruction is configured to instruct to adjust the current of the preset light emission element in the first area to the target adjustment current value. In this scheme, based on the difference between the brightness value of the preset light emission element in the first area and the preset brightness value, it is determined whether the brightness adjustment is needed for the first area, and the electronic apparatus automatically performs the brightness adjustment without manual intervention.

Figure 5:
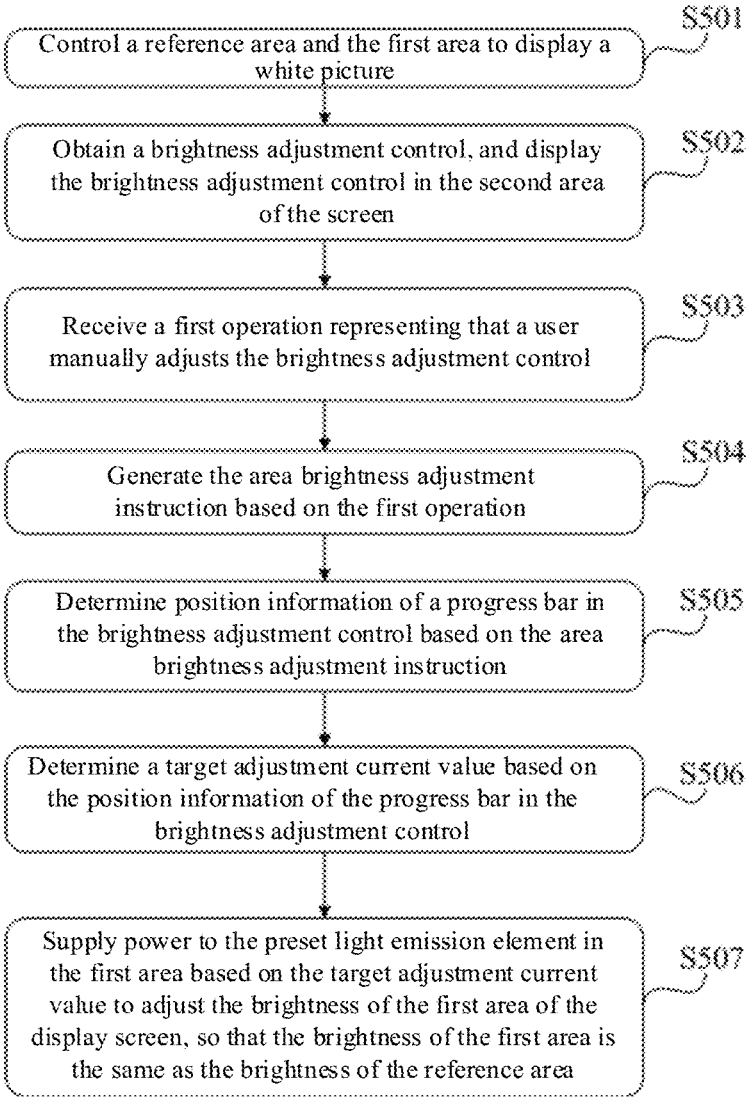
FIG. 5. is a flow chart of another example information processing method consistent with the present disclosure.

FIG. 5 is a flow chart of another example information processing method consistent with the present disclosure. The method includes the following processes.

S501, controlling a reference area and the first area to display a white picture.

The reference area belongs to the second area and surrounds the first area.

A process of manually adjusting the brightness of the first area is provided in some embodiments.

In some embodiments, in order to reduce an influence of a display content on the display screen on the adjustment during the manual adjustment process, the first area is displayed in white. Also, the reference area is set around the first area, and the reference area is also set to white.

Figure 6:
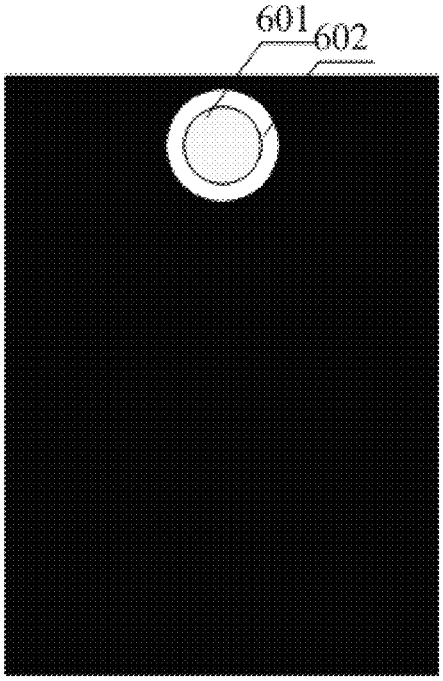
FIG. 6. is a schematic diagram of a display screen in an information processing method consistent with the present disclosure.

FIG. 6 is a schematic diagram of a display screen, including a first area 601 and a reference area 602. The first area is a circular area, and the reference area is an annular area surrounding the first area. The first area and the reference area are white, and areas other than the reference area in the second area are black. Since the brightness of the first area is lower than that of the reference area, the first area is represented in gray in FIG. 6.

It should be noted that when the white picture is displayed on the display screen, all three primary color pixels of RGB need to be provided with power to ensure that a situation when all the pixels are working is taken into account in the adjustment process, so that an adjustment result is more accurate.

S502, obtaining a brightness adjustment control, and displaying the brightness adjustment control in the second area of the screen.

Obtaining the brightness adjustment control can be triggered based on an operation of the user.

In some embodiments, the user performs a selection operation on functions such as setting of the electronic apparatus to select a function of the area brightness adjustment, and the obtaining of the brightness adjustment control is triggered based on the selection operation.

After the brightness adjustment control is obtained, it is displayed in the second area of the display screen of the electronic apparatus.

In some embodiments, the brightness adjustment control is displayed in the areas other than the reference area in the second area, so as to avoid affecting a visual perception of the user to displayed white in the reference area.

S503, receiving a first operation representing that the user manually adjusts the brightness adjustment control.

In some embodiments, the user manually adjusts the brightness adjustment control based on the visual perception.

In specific implementation, the brightness adjustment control corresponds to power supply parameters for the first area. The brightness adjustment control is manually adjusted, and the power supply parameters are adjusted accordingly, so that the brightness of the first area changes. If it is determined that the brightness of the first area is the same as the brightness of the reference area based on the visual perception of the user, the adjustment is stopped. When the adjustment is stopped, information of a progress bar in the brightness adjustment control is target adjustment information.

S504, generating the area brightness adjustment instruction based on the first operation.

The first operation is that the user performs an adjustment action on the brightness adjustment control, and the generation of the area brightness adjustment instruction is triggered based on the action of the user on the brightness adjustment control.

As an example, the user performs a sliding operation on the brightness adjustment control to trigger the generation of the area brightness adjustment instruction.

S505, determining position information of the progress bar in the brightness adjustment control based on the area brightness adjustment instruction.

The position information of the progress bar is obtained from the brightness adjustment control based on the area brightness adjustment instruction.

The position information of the progress bar is a position of the progress bar when the user visually perceives that the brightness of the first area is the same as that of the reference area during the manual adjustment process.

The progress bar corresponds to the power supply current for the preset light emission element in the first area.

In some embodiments, a lowest point of the progress bar in the brightness adjustment control is a current value of the preset light emission element presently applied to the first area, and a highest point of the progress bar is a preset limit current value of the preset light emission element in the first area.

In specific implementation, the brightness adjustment for the first area may be implemented multiple times. After the brightness adjustment is performed once, the electronic apparatus is used for a while, and when the brightness of the first area is different from the brightness of the second area, the brightness adjustment process can be performed again.

The lowest point of the progress bar in the brightness adjustment control is the current value of the preset light emission element presently applied to the first area, and the current value is the target adjustment current value determined during the last brightness adjustment.

In the brightness adjustment process for the first area, a result of a last adjustment is used as initial adjustment information.

The highest point of the progress bar in the brightness adjustment control is the preset limit current value of the preset light emission element in the first area, i.e., a highest current value that can be given to the preset light emission element, and the highest current value is an adjustable limit value.

It should be noted that, during an initial adjustment, the lowest point of the progress bar in the brightness adjustment control is the current value of the preset light emission element applied to the first area when the electronic apparatus leaves the factory. After at least one adjustment, when the brightness of the first area is adjusted, the lowest point of the progress bar in the brightness adjustment control is the target adjustment current value determined during the last adjustment.

S506, determining the target adjustment current value based on the position information of the progress bar in the brightness adjustment control.

In some embodiments, a ratio of the position of the progress bar in the brightness adjustment control to an overall progress bar is first determined, and a current value corresponding to the ratio is calculated based on the current values corresponding to the lowest point and the highest point of the progress bar in the brightness adjustment control, which is used as the target adjustment current value.

As an example, the current value corresponding to the lowest point of the progress bar in the brightness adjustment control is 20 mA, the current value corresponding to the highest point of the progress bar in the brightness adjustment control is 40 mA, and the ratio of the position of the progress bar to the overall progress bar is 25%, then a process of obtaining the target adjustment current value I by calculation is as follows:

$$I=20\text{ mA}+(40\text{ mA}-20\text{ mA})*25\%=25\text{ mA}$$

As an example, when the electronic apparatus leaves the factory, the power supply current of the light emission element in the first area is 20 mA (milliamps), and the highest power supply current value of the preset light emission element is 40 mA. After the electronic apparatus has been used for a while, the user can visually perceive that the brightness of the first area is much lower than the brightness of the second area. Therefore, the user performs the area brightness adjustment. In the displayed brightness adjustment control, the current corresponding to the lowest point of the progress bar is 20 mA and the current corresponding to the highest the point is 40 mA. After the adjustment according to the brightness adjustment control, the power supply current of the preset light emission element in the first area is adjusted from 20 mA to 25 mA. After used again for a while, the brightness of the first area is lower than the brightness of the second area, and the area brightness adjustment is performed again. In the displayed brightness adjustment control, the current corresponding to the lowest point of the progress bar is 25 mA and the current corresponding to the highest point is 40 mA. After the adjustment according to the brightness adjustment control, the power supply current of the preset light emission element in the first area is adjusted from 25 mA to 32 mA, and so on.

Since each adjustment is to increase the brightness of the first area, the determined target adjustment current value is gradually increased when the brightness of the first area is adjusted.

Figure 7:
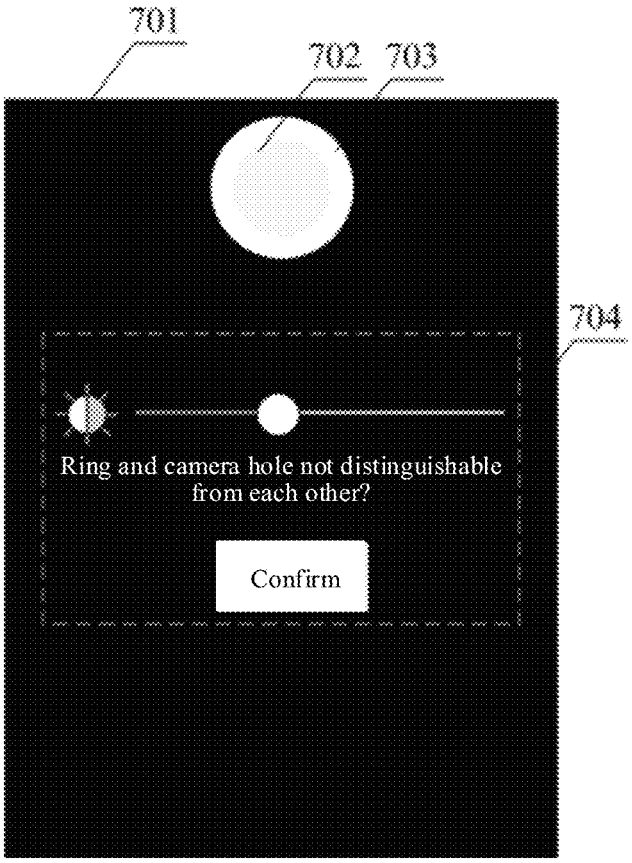
FIG. 7 is a schematic diagram of another display screen in an information processing method consistent with the present disclosure.

FIG. 7 is a schematic diagram of another display screen, including a second area 701, a first area 702, a reference area 703, and a brightness adjustment control area 704. The brightness adjustment control area includes the progress bar and a dialog box, and content of the dialog box includes "whether it cannot be distinguished between a ring and a camera hole" and "confirm."

The areas other than the reference area in the second area are black, and the first area and the reference area are white. Due to brightness difference, the first area and the reference area have a noticeable difference with naked eyes, and the brightness of the first area is lower than that of the reference area. The electronic apparatus responds to an operation of the user of dragging the progress bar and adjusts the power supply current of the preset light emission element in the first area in real time to change the brightness of the first area. When the user cannot distinguish the difference between the first area and the reference area, the user clicks "confirm" to end the adjustment operation. The electronic apparatus determines the corresponding target adjustment current value based on the position of the progress bar when the user clicks "confirm," so that a subsequent adjustment only needs to be based on the target adjustment current value to supply power to the preset light emission element in the first area.

S507, supplying power to the preset light emission element in the first area based on the target adjustment current value to adjust the brightness of the first area of the display screen, so that the brightness of the first area is the same as the brightness of the reference area.

After the target adjustment current value is determined, power is supplied to the preset light emission element in the first area based on the target adjustment current value, so that the brightness of the first area of the display screen is the same as the brightness of the reference area.

In specific implementation, the user may perform a certain operation to determine that the target adjustment current value is selected as the result of the adjustment, and the adjustment process is ended.

It should be noted that, during the area brightness adjustment process, the brightness of the first area is adjusted according to a white color (all pixels are powered), and the current when all three primary color pixels of RGB in the preset light emission element are powered is determined (such as 18 mA). Because power supply current of different pixels is different (power supply current of red pixel is 6 mA, power supply current of green pixel is 8 mA, and power supply current of blue pixel is 4 mA), power supply of unnecessary pixels can be stopped when other colors are displayed, and power is only supplied to the pixels that are needed. The power supply current is adjusted accordingly to determine an actual power supply current value of the preset light emission element in a specific display process according to the target adjustment current value.

In summary, in the information processing method consistent with the present disclosure, the reference area and the first area are controlled to display the white picture, and the reference area belongs to the second area and surrounds the first area. Obtaining the area brightness adjustment instruction includes: obtaining the brightness adjustment control, and displaying the brightness adjustment control in the second area of the screen; receiving the first operation representing that the user manually adjusts the brightness adjustment control; generating the area brightness adjustment instruction based on the first operation. In this scheme, the brightness of the first area can be adjusted based on the white picture displayed in the reference area and the first area on the display screen. In some embodiments, the user manually adjusts the brightness adjustment control to determine the target adjustment current value, and the manual adjustment has a high flexibility.

Figure 8:
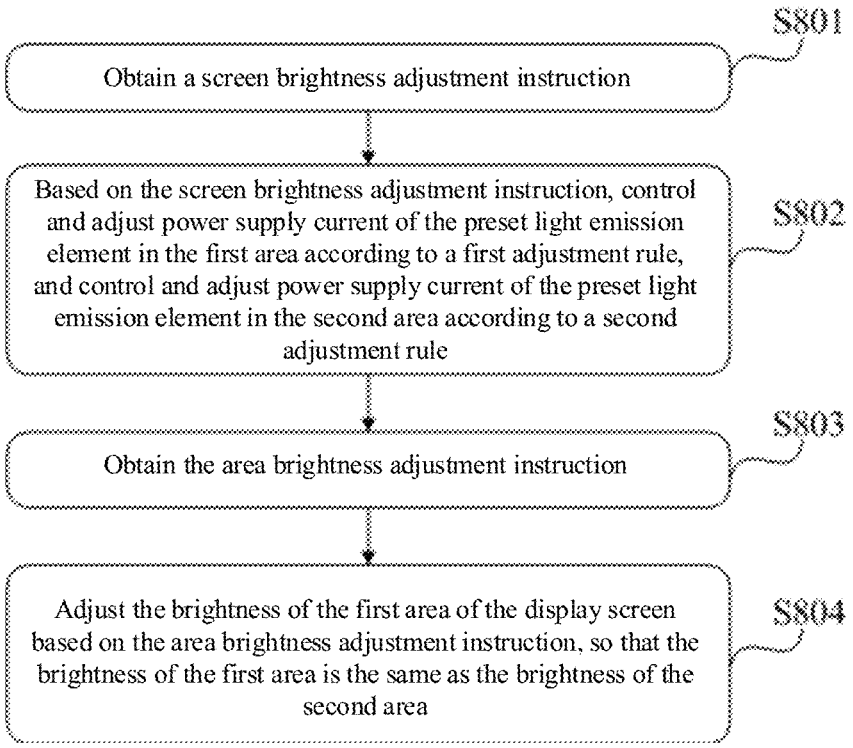
FIG. 8 is a flow chart of another example information processing method consistent with the present disclosure.

FIG. 8 is a flow chart of another example information processing method consistent with the present disclosure. The method includes the following processes.

S801, obtaining a screen brightness adjustment instruction.

The screen brightness adjustment instruction is configured to adjust the overall brightness of the display screen.

In some embodiments, the screen brightness adjustment instruction may be generated when the user manually selects an option to adjust the screen brightness, or may be generated when environmental brightness of the screen changes and the electronic apparatus automatically triggers the brightness adjustment.

The display screen includes the first area and the second area. The first area and the second area have different structures, which can be, in some embodiments, embodied in that layer structures of the screen used are different. The first area uses the ITO, while the second area uses the non-ITO. In order to achieve the same screen brightness, the two have different power supply currents, and the power supply current for the light emission element in the ITO is greater than the power supply current for the light emission element in the non-ITO. Also, in order to ensure the light transmittance of the first area in specific implementation, a pixel array of an organic light emission layer in the first area is sparser than that in the second area. In order to achieve the same screen brightness, the power supply current for the light emission element in the first area is greater than the power supply current for the light emission element in the second area.

Therefore, the first area and the second area have different adjustment rules. The first area corresponds to a first adjustment rule, and the second area corresponds to a second adjustment rule.

For a determination process of the target adjustment current value, reference can be made to the content described in the foregoing embodiments.

In specific implementation, when the first area of the display screen has not been performed the area brightness adjustment, a reference value of the first adjustment rule is a factory setting value; when the first area of the display screen has been performed the area brightness adjustment, the reference value of the first adjustment rule is the target adjustment current value determined during the last adjustment.

It should be noted that the reference value refers to a reference for adjusting the brightness of the first area, which is based on the power supply current when the first area is displayed as white (all three primary color pixels of RGB in the preset light emission element are powered), and the brightness of the first area is adjusted. If it is displayed in another color, a power supply current value for a corresponding part of the pixels is selected based on the target adjustment current value corresponding to the white. When the screen brightness is adjusted, the power supply current value determined based on the target adjustment current value is increased or decreased.

S802, based on the screen brightness adjustment instruction, controlling and adjusting the power supply current of the preset light emission element in the first area according to the first adjustment rule, and controlling and adjusting the power supply current of the preset light emission element in the second area according to the second adjustment rule.

An overall brightness change of the display screen is controlled based on the screen brightness adjustment instruction.

In some embodiments, the power supply current of the preset light emission element in the first area is controlled and adjusted based on the first adjustment rule, and the power supply current of the preset light emission element in the second area is controlled and adjusted based on the second adjustment rule.

Since an arrangement of the preset light emission elements in the first area is sparse in accordance with a set ratio relative to an arrangement of the preset light emission elements in the second area, when the current power supply currents of the two areas are determined, values of the power supply currents of the two areas are adjusted according to the sparse ratio.

It should be noted that, during the area brightness adjustment process, the brightness of the first area is adjusted according to the white color (all pixels are powered), and the current when all three primary color pixels of RGB in the preset light emission element are powered is determined (such as 18 mA). In the adjustment process, the first area and the reference area are both white, and they use the same brightness and pixel combination. Since the arrangements of the preset light emission elements in the first area and the second area are set according to a certain ratio, when the overall brightness is adjusted, a current adjustment is also performed based on the ratio. The sparser the arrangement, the greater a current difference is increased when the brightness is increased, and the smaller a current difference is decreased when the brightness is decreased.

It should be noted that processes S801-S802 are the process of adjusting the overall brightness of the display screen during use, and processes S803-S804 below are the process of adjusting area brightness of the first area of the display screen during use. There is no clear order restriction between the two. When the screen brightness required by environment/user changes, processes S801-S802 can be performed to adjust the overall brightness of the display screen; when the brightness difference between the first area and the second area is visible to the user and needs to be adjusted, processes S803-S804 can be performed to adjust the area brightness of the first area in the display screen.

S803, obtaining the area brightness adjustment instruction.

S804, adjusting the brightness of the first area of the display screen based on the area brightness adjustment instruction, so that the brightness of the first area is the same as the brightness of the second area.

Processes S803-S804 are consistent with processes S101-S102 in the foregoing embodiments, and detailed description thereof will not be repeated herein.

In summary, the information processing method consistent with the present disclosure also includes: obtaining the screen brightness adjustment instruction, where the first area corresponds to the first adjustment rule, the second area corresponds to the second adjustment rule, and the reference value of the first adjustment rule is the target adjustment current value; based on the screen brightness adjustment instruction, controlling and adjusting the power supply current of the preset light emission element in the first area according to the first adjustment rule, and controlling and adjusting the power supply current of the preset light emission element in the second area according to the second adjustment rule. In this scheme, when the overall brightness of the screen is adjusted, the brightness of different areas of the screen can be adjusted with selecting different adjustment rules based on the result of the area brightness adjustment, which ensures that the overall brightness of the screen is maintained consistent when the overall brightness of the screen is adjusted, so that the user experience is improved.

Corresponding to the information processing method consistent with the present disclosure, the present disclosure also provides a device and an electronic apparatus to which the information processing method is applied to.

Figure 9:
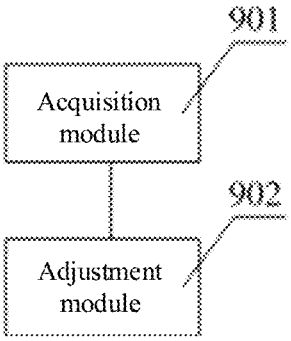
FIG. 9. is a schematic structural diagram of an information processing device according to an embodiment of the present disclosure.

FIG. 9 is a schematic structural diagram of an information processing device according to an embodiment of the present disclosure. The device includes the following structures: an acquisition module 901 and an adjustment module 902. The acquisition module is configured to obtain an area brightness adjustment instruction. The adjustment module is configured to adjust brightness of a first area of a display screen based on the area brightness adjustment instruction, so that the brightness of the first area is the same as brightness of a second area. The first area corresponds to a collection area of an image collection assembly. The image collection assembly senses light passing through the first area of the display screen to form an image. The first area is a partial area of the display screen, and the second area of the display screen is an area of the display screen excluding the first area.

In some embodiments, the acquisition module includes a first acquisition unit and a first instruction generation unit. The first acquisition unit is configured to obtain a brightness value of a preset light emission element in the first area. The first instruction generation unit is configured to generate the area brightness adjustment instruction based on difference between the brightness value and a preset brightness value satisfying a preset condition. The area brightness adjustment instruction is configured to instruct to adjust a current of the preset light emission element in the first area to a target adjustment current value.

The device also includes a control module configured to control a reference area and the first area to display a white picture. The reference area belongs to the second area and surrounds the first area.

In some embodiments, the acquisition module includes a second acquisition unit, a reception unit, and a second instruction generation unit. The second acquisition unit is configured to obtain a brightness adjustment control, and display the brightness adjustment control in the second area of the screen. The reception unit is configured to receive a first operation representing that a user manually adjusts the brightness adjustment control. The second instruction generation unit is configured to generate the area brightness adjustment instruction based on the first operation.

In some embodiments, the adjustment module is, in some embodiments, configured to: determine position information of a progress bar in the brightness adjustment control based on the area brightness adjustment instruction, where a lowest point of the progress bar in the brightness adjustment control is a current value of the preset light emission element presently applied to the first area, and a highest point of the progress bar is a preset limit current value of the preset light emission element in the first area; determine the target adjustment current value based on the position information of the progress bar in the brightness adjustment control; and supply power to the preset light emission element in the first area based on the target adjustment current value to adjust the brightness of the first area of the display screen, so that the brightness of the first area is the same as the brightness of the reference area.

In some embodiments, the device also includes a screen adjustment module. The screen adjustment module is configured to: obtain a screen brightness adjustment instruction, where the first area corresponds to a first adjustment rule, the second area corresponds to a second adjustment rule, and a reference value of the first adjustment rule is the target adjustment current value; based on the screen brightness adjustment instruction, control and adjust power supply current of the preset light emission element in the first area according to the first adjustment rule, and control and adjust power supply current of the preset light emission element in the second area according to the second adjustment rule.

The information processing device provided by the present disclosure includes the acquisition module and the adjustment module. The acquisition module is configured to obtaining the area brightness adjustment instruction. The adjustment module is configured to adjust the brightness of the first area of the display screen based on the area brightness adjustment instruction, so that the brightness of the first area is the same as the brightness of the second area. The first area corresponds to the collection area of the image collection assembly. The image collection assembly senses the light passing through the first area of the display screen to form the image. The first area is a partial area of the display screen, and the second area of the display screen is an area of the display screen excluding the first area. In this scheme, the brightness of the first area corresponding to the image collection assembly in the display screen is adjusted based on the brightness adjustment instruction, so that the brightness of the first area is consistent with the brightness of other areas in the display screen, which improves display effect of the screen.

Figure 10:
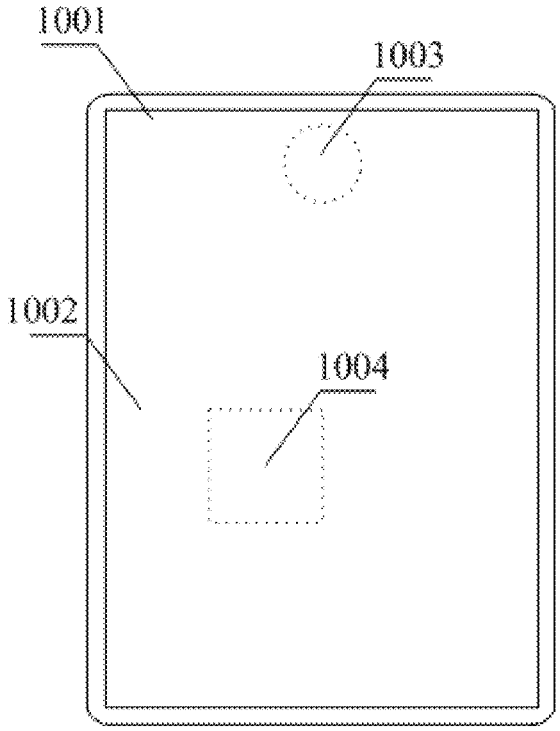
FIG. 10. is a schematic structural diagram of an electronic apparatus according to an embodiment of the present disclosure.

FIG. 10 is a schematic structural diagram of an electronic apparatus according to an embodiment of the present disclosure. The electronic apparatus includes the following structures: a main body 1001, a display screen 1002, an image collection assembly 1003, and a processor 1004. The display screen is arranged at a first side of the main body. The display screen includes a first area and a second area, and the second area is an area of the display screen excluding the first area. The image collection assembly is arranged at a side of the display screen close to the main body, and a collection area of the image collection assembly corresponds to the first area of the display screen. The image collection assembly senses light passing through the first area of the display screen to form an image. The processor is configured to obtain an area brightness adjustment instruction, and adjust brightness of the first area of the display screen based on the area brightness adjustment instruction, so that the brightness of the first area is the same as brightness of the second area.

The processor is, in some embodiments, a functional structure for data processing in the electronic apparatus, such as a central processing unit (CPU).

In some embodiments, the electronic apparatus also includes a power supply for supplying power to the display screen, and, in some embodiments, supplying current for the first area and the second area.

In some embodiments, obtaining the area brightness adjustment instruction includes: obtaining a brightness value of a preset light emission element in the first area; generating the area brightness adjustment instruction based on difference between the brightness value and a preset brightness value satisfying a preset condition. The area brightness adjustment instruction is configured to instruct to adjust a current of the preset light emission element in the first area to a target adjustment current value.

In some embodiments, obtaining the area brightness adjustment instruction includes: obtaining a brightness adjustment control, and displaying the brightness adjustment control in the second area of the screen; receiving a first operation representing that a user manually adjusts the brightness adjustment control; and generating the area brightness adjustment instruction based on the first operation.

In some embodiments, adjusting the brightness of the first area of the display screen based on the area brightness adjustment instruction includes: determining position information of a progress bar in the brightness adjustment control based on the area brightness adjustment instruction, where a lowest point of the progress bar in the brightness adjustment control is a current value of the preset light emission element presently applied to the first area, and a highest point of the progress bar is a preset limit current value of the preset light emission element in the first area; determining the target adjustment current value based on the position information of the progress bar in the brightness adjustment control; and supplying power to the preset light emission element in the first area based on the target adjustment current value to adjust the brightness of the first area of the display screen, so that the brightness of the first area is the same as the brightness of the reference area.

In some embodiments, the processor is also configured to: obtain a screen brightness adjustment instruction, where the first area corresponds to a first adjustment rule, the second area corresponds to a second adjustment rule, and a reference value of the first adjustment rule is the target adjustment current value; based on the screen brightness adjustment instruction, control and adjust power supply current of the preset light emission element in the first area according to the first adjustment rule, and control and adjust power supply current of the preset light emission element in the second area according to the second adjustment rule.

The electronic apparatus provided by the present disclosure includes the main body, the display screen, the image collection assembly, and the processor. The display screen is arranged at the first side of the main body. The display screen includes the first area and the second area, and the second area is the area of the display screen excluding the first area. The image collection assembly is arranged at the side of the display screen close to the main body, and the collection area of the image collection assembly corresponds to the first area of the display screen. The image collection assembly senses the light passing through the first area of the display screen to form the image. The processor is configured to obtain the area brightness adjustment instruction, and adjust the brightness of the first area of the display screen based on the area brightness adjustment instruction, so that the brightness of the first area is the same as the brightness of the second area. In this scheme, the brightness of the first area corresponding to the image collection assembly in the display screen is adjusted based on the brightness adjustment instruction, so that the brightness of the first area is consistent with the brightness of other areas in the display screen, which improves display effect of the screen.

The various embodiments in this specification are described in a progressive manner. Each embodiment focuses on the differences from other embodiments, and for the same or similar parts between the various embodiments, reference can be made to each other. As for the device provided in the embodiments, since it corresponds to the method provided in the embodiments, the description is relatively simple, and for the relevant part, reference can be made to the description of the method.

The foregoing description of the provided embodiments enables those skilled in the art to implement or use the present disclosure. Various modifications to these embodiments will be obvious to those skilled in the art, and the general principles defined herein can be implemented in other embodiments without departing from the spirit or scope of the present disclosure. Therefore, the present disclosure will not be limited to the embodiments shown herein, but should conform to the widest scope consistent with the principles and novel features provided herein.

What is claimed is:

1. An information processing method comprising:

obtaining an area brightness adjustment instruction;

adjusting brightness of a first area of a display screen based on the area brightness adjustment instruction, so that the brightness of the first area is equal to brightness of a second area of the display screen;

obtaining a screen brightness adjustment instruction, the first area corresponding to a first adjustment rule, the second area corresponding to a second adjustment rule, and a reference value of the first adjustment rule being a target adjustment current value; and based on the screen brightness adjustment instruction, controlling and adjusting a power supply current of a preset light emission element in the first area according to the first adjustment rule, and controlling and adjusting a power supply current of a preset light emission element in the second area according to the second adjustment rule;

wherein:

the first area corresponds to a collection area of an image collection assembly;

the image collection assembly senses light passing through the first area of the display screen to form an image;

the first area is a partial area of the display screen; and the second area is an area of the display screen excluding the first area.

2. The method of claim 1, further comprising, before adjusting the brightness of the first area:

controlling a reference area and the first area to display a white picture;

wherein the reference area belongs to the second area and surrounds the first area.

3. The method of claim 1, wherein obtaining the area brightness adjustment instruction includes:

obtaining a brightness value of the preset light emission element in the first area; and generating the area brightness adjustment instruction in response to a difference between the brightness value and a preset brightness value satisfying a preset condition, the area brightness adjustment instruction being configured to instruct to adjust the power supply current of the preset light emission element in the first area to the target adjustment current value.

4. The method of claim 1, wherein obtaining the area brightness adjustment instruction includes:

obtaining a brightness adjustment control;

displaying the brightness adjustment control in the second area;

receiving an operation on the brightness adjustment control; and generating the area brightness adjustment instruction based on the first operation.

5. The method of claim 4, further comprising, before adjusting the brightness of the first area:

controlling a reference area and the first area to display a white picture;

wherein the reference area belongs to the second area and surrounds the first area.

6. The method of claim 5, wherein adjusting the brightness of the first area includes:

determining position information of a progress bar in the brightness adjustment control based on the area brightness adjustment instruction, a lowest point of the progress bar in the brightness adjustment control being a current value of the preset light emission element presently applied to the first area, and a highest point of the progress bar being a preset limit current value of the preset light emission element in the first area;

determining the target adjustment current value based on the position information of the progress bar in the brightness adjustment control; and supplying power to the preset light emission element in the first area based on the target adjustment current value to adjust the brightness of the first area, so that the brightness of the first area is equal to brightness of the reference area.

7. An electronic apparatus comprising:

a main body;

a display screen arranged at a side of the main body and including a first area and a second area, the second area being an area of the display screen excluding the first area;

an image collection assembly arranged at a side of the display screen close to the main body and including a collection area corresponding to the first area of the display screen, the image collection assembly sensing light passing through the first area of the display screen to form an image; and a processor that:

obtains an area brightness adjustment instruction;

adjusts brightness of the first area of the display screen based on the area brightness adjustment instruction, so that the brightness of the first area is equal to brightness of the second area;

obtains a screen brightness adjustment instruction, the first area corresponding to a first adjustment rule, the second area corresponding to a second adjustment rule, and a reference value of the first adjustment rule being a target adjustment current value; and based on the screen brightness adjustment instruction, controls and adjusts a power supply current of a preset light emission element in the first area according to the first adjustment rule, and controlling and adjusting a power supply current of a preset light emission element in the second area according to the second adjustment rule.

8. The electronic apparatus of claim 7, wherein the processor further, before adjusting the brightness of the first area:

controls a reference area and the first area to display a white picture, the reference area belonging to the second area and surrounding the first area.

9. The electronic apparatus of claim 7, wherein the processor further:

obtains a brightness value of the preset light emission element in the first area; and generates the area brightness adjustment instruction in response to a difference between the brightness value and a preset brightness value satisfying a preset condition, the area brightness adjustment instruction being configured to instruct to adjust the power supply current of the preset light emission element in the first area to the target adjustment current value.

10. The electronic apparatus of claim 7, wherein the processor further:

obtains a brightness adjustment control;

displays the brightness adjustment control in the second area;

receives an operation on the brightness adjustment control; and generates the area brightness adjustment instruction based on the first operation.

11. The electronic apparatus of claim 10, wherein the processor further, before adjusting the brightness of the first area:

controls a reference area and the first area to display a white picture, the reference area belonging to the second area and surrounding the first area.

12. The electronic apparatus of claim 11, wherein the processor further:

determines position information of a progress bar in the brightness adjustment control based on the area brightness adjustment instruction, a lowest point of the progress bar in the brightness adjustment control being a current value of the preset light emission element presently applied to the first area, and a highest point of the progress bar being a preset limit current value of the preset light emission element in the first area;

determines the target adjustment current value based on the position information of the progress bar in the brightness adjustment control; and supplies power to the preset light emission element in the first area based on the target adjustment current value to adjust the brightness of the first area, so that the brightness of the first area is equal to brightness of the reference area.

13. An information processing method comprising:

obtaining an area brightness adjustment instruction, including:

obtaining a brightness adjustment control;

displaying the brightness adjustment control in a first area;

receiving an operation on the brightness adjustment control; and generating the area brightness adjustment instruction based on the first operation;

controlling a reference area and a second area to display a white picture, the reference area belonging to the first area and surrounding the second area, the second area corresponding to a collection area of an image collection assembly, the image collection assembly sensing light passing through the second area of the display screen to form an image, the second area being a partial area of the display screen, and the first area being an area of the display screen excluding the second area; and adjusting brightness of the second area of a display screen based on the area brightness adjustment instruction, so that the brightness of the first area is equal to brightness of the second area of the display screen, including:

determining position information of a progress bar in the brightness adjustment control based on the area brightness adjustment instruction, a lowest point of the progress bar in the brightness adjustment control being a current value of a preset light emission element presently applied to the second area, and a highest point of the progress bar being a preset limit current value of the preset light emission element in the second area;

determining a target adjustment current value based on the position information of the progress bar in the brightness adjustment control; and supplying power to the preset light emission element in the second area based on the target adjustment current value to adjust the brightness of the second area, so that the brightness of the second area is equal to brightness of the reference area.

* * * * *